United States Patent [19]

Martin et al.

[11] Patent Number: 4,776,832

[45] Date of Patent: Oct. 11, 1988

[54] CENTRIFUGE HAVING MULTIPLE INDUCTION MOTORS FOR ROTATING OBJECTS ABOUT A SECOND AXIS

[75] Inventors: Donald P. Martin, Wheeling; T. Edward Black, Buffalo Grove; Vidas P. Kazlauskas, Waukegan, all of Ill.

[73] Assignee: Abbott Laboratories, North Chicago, Ill.

[21] Appl. No.: 940,473

[22] Filed: Dec. 10, 1986

Related U.S. Application Data

[63] Continuation-in-part of Ser. No. 714,313, Mar. 21, 1985, abandoned.

[51] Int. Cl.[4] ..... B04B 5/02

[52] U.S. Cl. ..... 494/19; 494/37; 494/84

[58] Field of Search ..... 494/16, 19, 37, 84, 494/85; 436/177

[56] References Cited

U.S. PATENT DOCUMENTS 3,848,796 11/1974 Bull ..... 494/19

3,850,368 11/1974 Boeckeler ..... 494/19

4,092,113 5/1978 Hardy ..... 436/177

OTHER PUBLICATIONS

Two-Dimensional Centrifugation for Desk-Top Clinical Chemistry, Clinical Chemistry, vol. 31, No. 9, pp. 1457–1463, (1985), Sep.

*Primary Examiner*—Robert W. Jenkins

*Attorney, Agent, or Firm*—Thomas D. Brainard; Martin L. Katz; Dennis K. Shelton

[57] ABSTRACT

An improved centrifuge, including a main wheel for rotating objects to be subjected to centrifugal force about a main axis of rotation, is disclosed. Such objects are simultaneously rotated about a second axis of rotation from a first to a second position, and the centrifuge is improved by the inclusion therein of multiple reversing induction motors including a stationary stator and multiple induction rotors attached to the main wheel that eliminate electrical slip rings or mechanical linkages as controls for effecting the rotation of the objects from the first to the second position.

3 Claims, 3 Drawing Sheets

CENTRIFUGE HAVING MULTIPLE INDUCTION MOTORS FOR ROTATING OBJECTS ABOUT A SECOND AXIS

CROSS REFERENCE TO RELATED APPLICATIONS

This application is a continuation in part of application Ser. No. 714,313, filed Mar. 21, 1985, now abandoned.

BACKGROUND OF THE INVENTION

In co pending U.S. patent applications Ser. Nos. 606,785 (now abandoned), 606,786 (now abandoned), and 606,787 now U.S. Pat. No. 4,632,908, the disclosure of which are incorporated herein by reference, and in an article by Schultz et al., *Two-Dimensional Centrifugation for Desk-Top Clinical Chemistry,* Clin. Chem., Vol. 31, No. 9, pp 1457–63, (1985), an analytical cartridge centrifuge for bioanalysis of biological samples such as blood serum, plasma, spinal fluid and the like is described. One of the requirements for the successful operation of such an apparatus is that a test cartridge which is being revolved by a centrifuge to generate centrifugal force must be independently rotated approximately 90 degrees about its own axis to change the vector of the centrifugal force applied to its contents. In order perform this manuever there needs to be a separation in the second axis motor to allow for the rotation of the test cartridge on a shaft which is also revolving about the main centrifuge rotor (wheel) axis. Making this separation at the electrical level usually involves employing expensive slip rings having poor reliability and high maintenance requirements. Making this separation at the mechanical level involves mechanical linkages which add complexity and detract from overall reliability. The better solution and subject matter of the present invention is to separate a second axis induction motor between its stator pair and its induction rotor. At this point the energy transfer is via magnetic lines of force through air. Top reliability and great simplicity therefore can be obtained by separating the induction motor into two parts at this magnetic region where the one part can remain stationary while the other part can revolve with rotation of the main centrifuge wheel.

SUMMARY OF THE INVENTION

The present invention provides an improved analytical centrifuge apparatus for bioanalysis, as is described in the aforesaid co pending U.S. patent applications and article, wherein analytical cartridges are held on the main wheel of a centrifuge and testing of biological samples is carried out within the cartridges by changing the direction of centrifugal force applied to the contents of the cartridges to effect mixing of reagents and sample. The secondary rotation of the cartridge itself is effected simultaneously with the rotation of the main wheel of the centrifuge. The present invention finds particular application as an improvement in analytical centrifuge apparatus, as will be apparent from the description hereof.

In one aspect the present invention is directed toward a centrifuge including a main wheel for rotating a bucket means for holding objects to be subjected to centrifugal force about a main axis of rotation while such objects are simultaneously rotated about a second axis of rotation from a first to a second position. The centrifuge comprises a plurality of induction rotors attached to the main wheel which rotates the induction rotors about the main axis, and which positions the induction rotors over a pair of stators; a pair of stators mounted on the base of the centrifuge whereby the induction rotors are rotated over the stators by the main wheel; and a plurality of bucket means for holding objects. The bucket means are mechanically associated with a corresponding induction rotor by gear means whereby rotation of the induction rotor is transferred to the bucket means. Rotation of the bucket means causes the objects to be rotated from a first to a second position.

In another aspect the subject invention is directed toward a method for rotating a bucket means for holding objects to be subjected to centrifugal force about an axis of rotation independent from and simultaneously with the main axis of rotation of a centrifuge apparatus. The method comprises rotating an induction rotor attached to a main wheel of a centrifuge about a main axis, whereby the induction rotor is passed over a pair of stators; and energizing one of the stators to apply an appropriate magnetic field to the induction rotor which causes it to rotate about a second axis of rotation. The induction rotor is mechanically associated with a corresponding bucket means by gear means whereby rotation of the induction rotor is transferred to the bucket means.

The method of the present invention can further include the step of energizing the other stator to apply a magnetic field to the same induction rotor which causes it to rotate about a second axis of rotation in an opposite direction. The induction rotor is mechanically associated with a corresponding bucket means by gear means whereby rotation of the induction rotor is transferred to the bucket means. The reverse movement of the induction rotor can return the bucket means to the original position.

DETAILED DESCRIPTION OF THE INVENTION

The subject invention is directed towards an improved analytical centrifuge apparatus for conducting chemical analysis of biological samples. The improvement of this particular centrifuge device comprises a means for rotating the objects to be analyzed in a second axis of rotation from the main axis of rotation. By rotating the objects to be analyzed in a second axis of rotation a bioanalysis procedure can be completed by changing the direction of centrifugal force operating on the objects.

The means for rotating the objects about a second axis of rotation is provided by multiple reversing induction motors. The motors are comprised of an induction rotor passing over a pair of stators located beneath the main wheel. The induction rotors are in turn connected to holders holding the objects to be bioanalyzed whereby movement of the induction rotors induces movement in the object by changing the direction of centrifugal force. An intermittent current passing through an individual stator produces a magnetic field (stator field) which induces a current in the induction rotors passing overhead. This current is a physical effect known as an Eddy current, which is an electric current induced in electrical conductors experiencing motion relative to a magnetic field. The Eddy current creates its own magnetic field which always opposes the "parent" stator field and thus causes a magnetic drag on half the induction rotor which makes it turn because of torgue generated via drag.

In a preferred embodiment, e.g., as an improvement upon the apparatus set forth in the aforesaid co pending U.S. patent applications, the invention provides an improved centrifugal analytical test instrument which has test cartridges, or "packs" that must be centrifuged and simultaneously rotated approximately 90 degrees and then returned to their original (non rotated) position, in order to carry out analytical tests. Each test pack fits into a holder, or "bucket", on the wheel of the main centrifuge assembly and can be rotated independently of other buckets present on the main wheel.

In accordance with the invention, such an analytical instrument can be improved by inclusion therein of multiple induction motors. In their essential features, the motors, in a preferred embodiment, include a single stationary stator pair and a plurality of induction rotors attached in a planetary manner to a main, centrally rotating wheel.

Geardowns, clutches and stops allow limited movement of cartridge "bucket" members which are mounted on the main wheel and rotate through a 90 degree angle. Each of the multiple induction rotors is connected to a shaft having a pinion gear and is supported by two bearings. The pinion gear engages with a gear which drives a shaft through a clutch arrangement. This shaft has a pinion gear which drives a sector gear on the bucket, whose rotation, through, e.g., 90 degrees, is one of the primary aspects of this invention.

Figure 3:
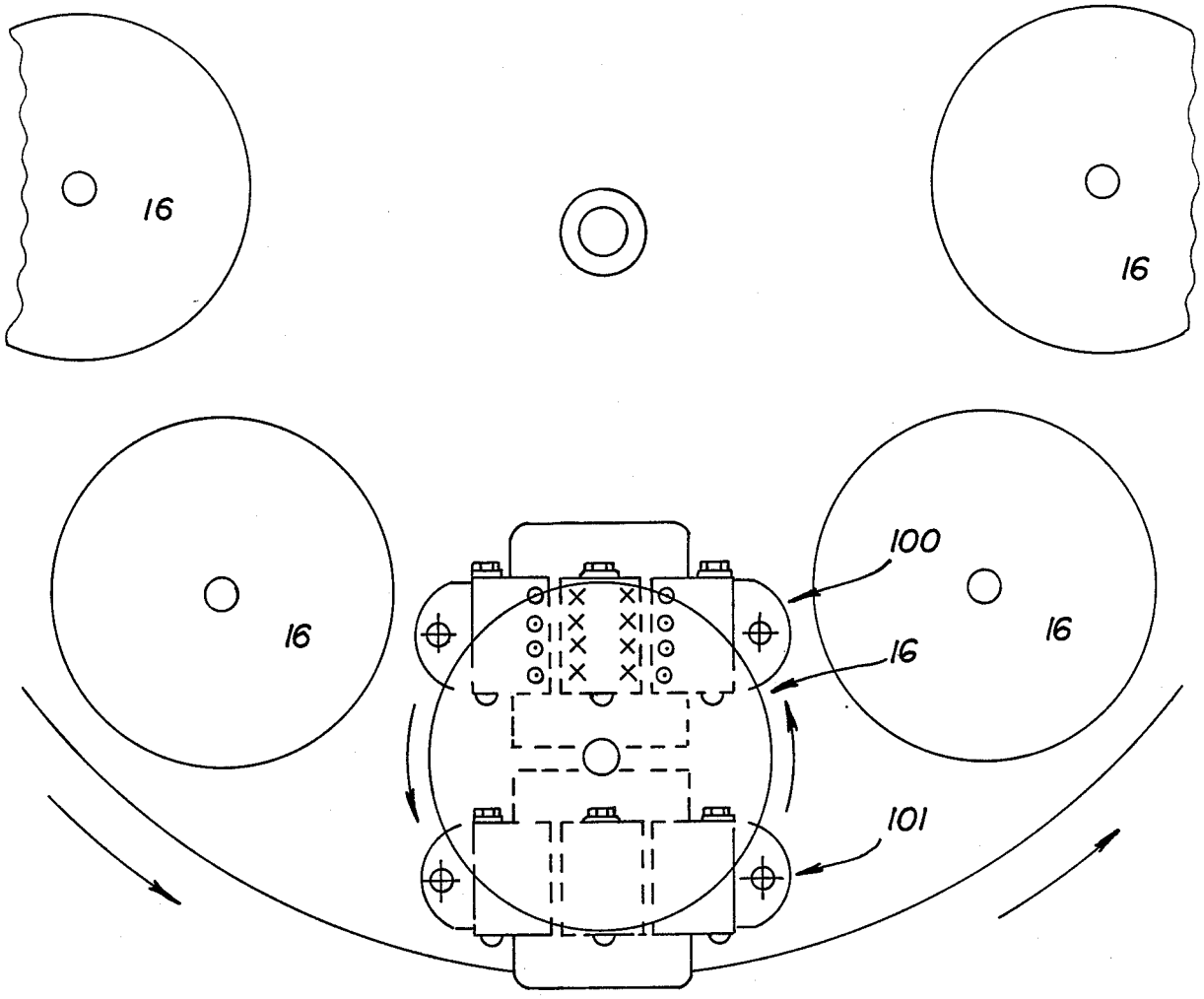
FIG. 3 is an overhead plane view of a plurality of induction rotors passing over a pair of stators as contemplated by the present invention.

The main, centrally rotating wheel is driven by a brushless permanent magnet DC motor. This main rotation causes the multiple induction rotors to revolve about the center of the main wheel. As shown in FIG. 3, the multiple induction rotors 16 are revolved such that they pass curvelinear successively over a single pair of stators (100 and 101).

In other embodiments, the rotors could pass in a linear mode over a single pair of stators without deviating from the scope of this invention. One stator is used to cause clockwise rotation of each induction rotor, and the other stator is used to cause counter clockwise rotation of each induction rotor. In order to obtain independent control over each induction rotor, associated microprocessor controlled electronics are employed to energize the stators so that the appropriate stator field is applied momentarily at the appropriate time, when each induction rotor is traversing over the stator pair.

A photoelectric pickup is situated such that it senses the position of the main wheel, and this information is used for the electronic synchronization of the stator pair. Each bucket is off center weighted so that if the stators are not energized the centrifugal force will keep the bucket rotated either fully clockwise, or fully counterclockwise as it revolves around the main centrifuge center. For this reason a stator need only be energized when it is desired to rotate a particular induction rotor. When clockwise or counter-clockwise rotation of a particular bucket is desired only the respective stator in the pair will be energized. If no motion is desired then neither stator will be energized.

Referring now to FIGS. 1 through 4, all mechanical parts necessary for a preferred embodiment of the invention are shown.

Figure 1:
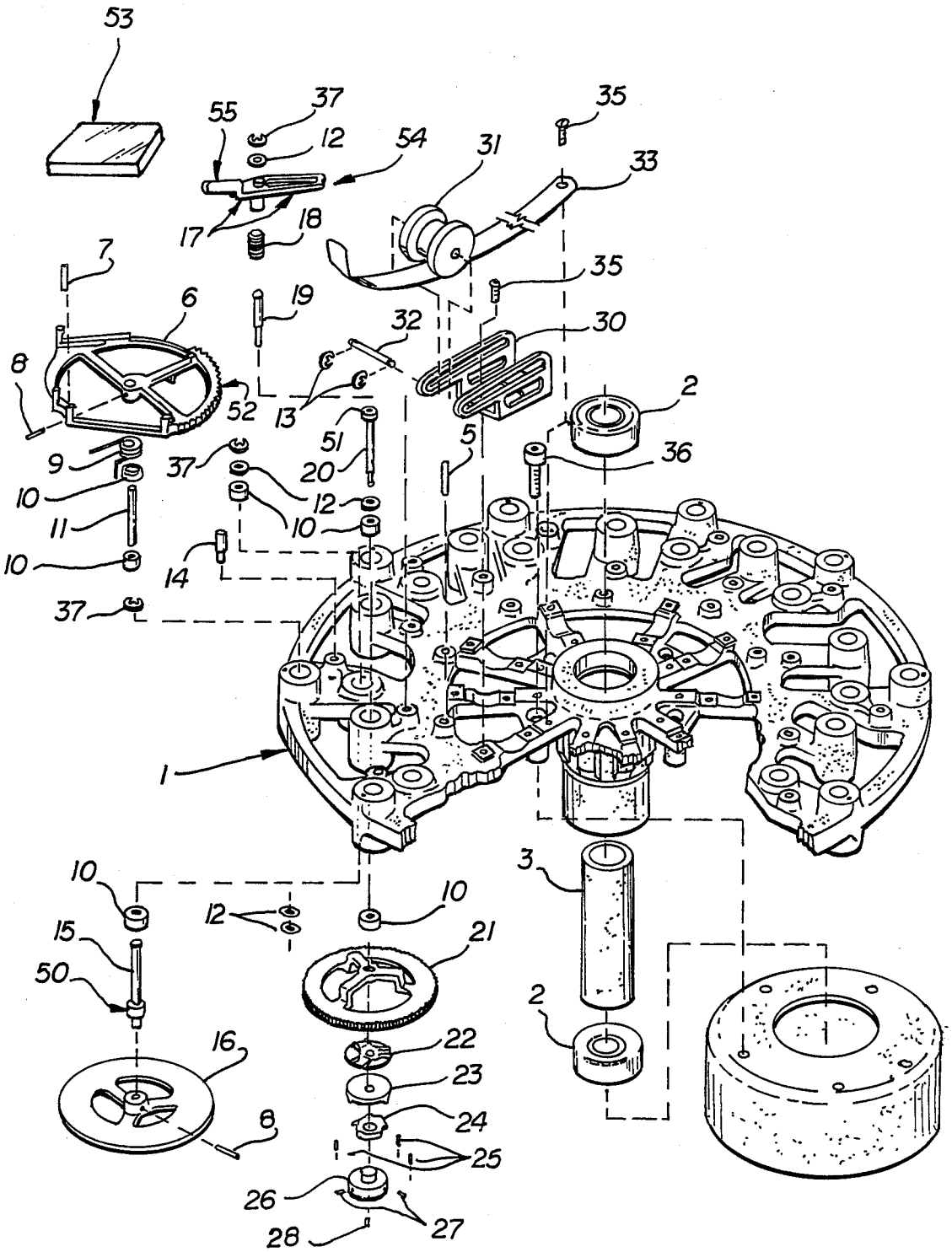
FIG. 1 is an exploded perspective view of the wheel assembly of improved centrifuge apparatus according to the present invention.
Figure 2:
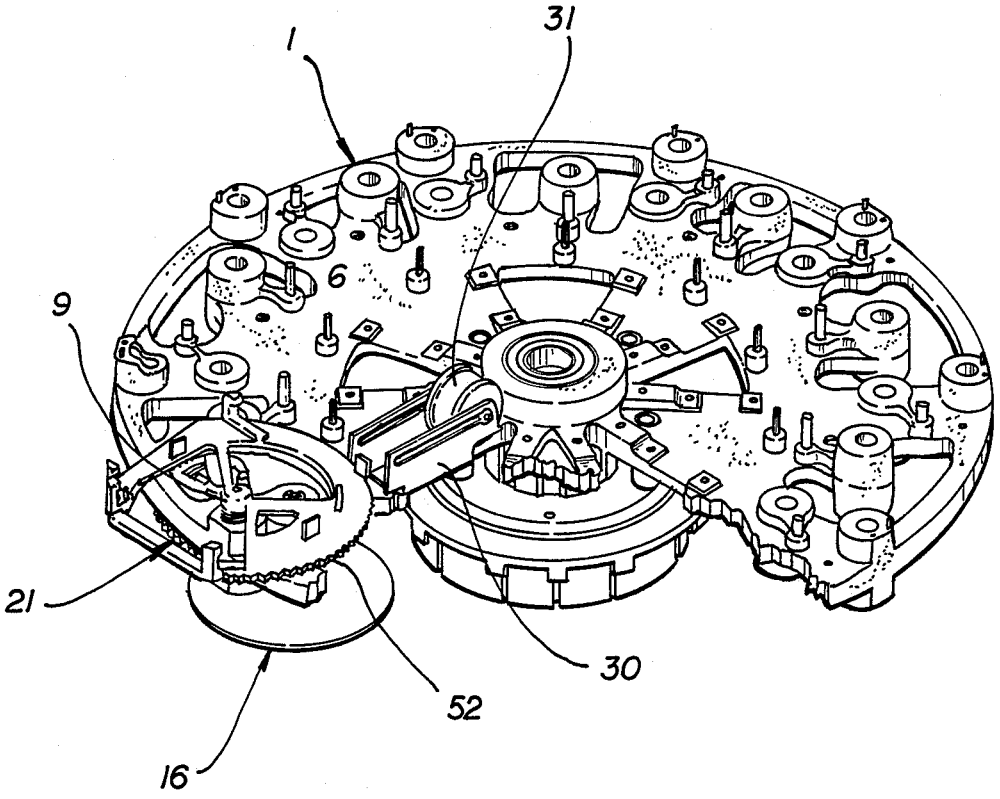
FIG. 2 is a partial top plan view of the base assembly of the wheel assembly as shown in FIG. 1.

Bearings 2 (FIG. 1) are press fitted into the main wheel casting 1 and held at the propet distance by spacer 3. These bearings 2 fit over main shaft during final assembly of the centrifuge wheel assembly (FIG. 1) onto the base assembly. As shown in FIG. 1, induction rotor 16 fits over shaft assembly 15 and is held in place by pin 8. Shaft assembly 15 is supported by two bearings 10 which are press fitted into the main casting as shown. Washer 12 and retaining ring 37 are used to retain the induction rotor and shaft assembly at a proper elevation. The pinion 50 on this assembly engages intermediate gear 21 which drives a spring loaded slip clutch assembly, comprising slip elements 22 and 23, spring 24 and bottom retention member 26, and associated fasteners 25, 27 and 28. Shaft assembly 20 passes through spacing washer 12 and bearings 10, washers 12 and the remainder of the clutch items 21, 22, 23, 24 and 26. Gear 51 engages with sector gear 52 which is part of test cartridge bucket 6. Bucket 6 mounts on shaft 11 with pin 8, and shaft 11 passes through home spring 9 and two bearings 10 and retaining ring 37. These bearings 10 are press fitted into the main casting. Pin 14 provides a stop for bucket 6 and permits it to turn only approximately 90 degrees.

Optionally the centrifuge apparatus may contain an autobalance mechanism which is the subject matter of a copending patent application. Test cartridge 53 will engage lever arm 17 and prevent counterweight 31 from moving. This is accomplished by end 55 of lever 17 being at rest within the area of bucket 6 where the cartridge 53 is to be positioned. Thus, when a cartridge 53 is inserted into bucket 6, it displaces the end 55 of lever 17. This displacement causes the opposite end of lever 17 to be correspondingly displaced, whereby notch 54 engages counterweight 31, preventing the counterweight 31 from being displaced by centrifugal force.

If the cartridge 53 is not present at a particular station, then lever arm 17 will not be displaced, and when the centrifuge is still rotating at slow speed during accelleration the initial centrifugal force will cause counterweight 31 mounted on shaft 32 and retained by rings 13 to slide in bracket 30 toward the outside of the centrifuge. The amount of weight and the distance it moves are calculated to be the equivalent of an installed test cartridge. If the cartridge is installed, then the lever arm 17 will be rotated into a position that will interfere with counterweight at the notch 54 in lever arm 17. As the counterweight forces itself into this notch it causes further rotation of the lever arm in the direction where the opposite end 55 moves away from the test cartridge. This latter movement allows free rotation of the cartridge 53. When the centrifuge stops and the cartridge 53 is removed, spring 18 returns the lever to the home position where it does not interfere with the counterweight unless another cartridge is installed. Spring 33 is a coiled flat spring which returns the counterweight to a central rest position when the centrifuge is rotating slower than about 100 rpm.

Figure 4:
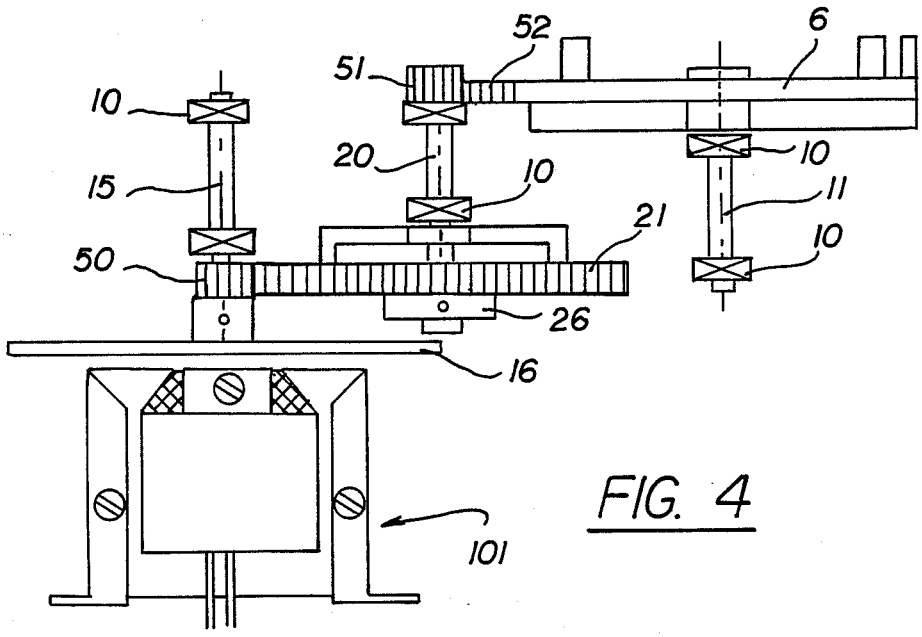
FIG. 4 is a side view of an induction rotor and associated assembly positioned over a stator pair as contemplated by the present invention.

Now with respect to the mechanisms of the present invention, best depicted in FIGS. 1, 3, and 4, at each test cartridge position on the centrifuge there is an induction rotor 16, shaft 15, bearings 10, communicating gear drive 50, 21, 51, and 52 to the bucket 6 which holds the test cartridge 53. The stator pair located on the instrument base is used to rotate all test cartridge positions independently.

To rotate a test cartridge 53 one of the stators 100 or 101, depending on the direction of rotation desired, is energized producing a strong magnetic field. The Eddy currents generated in induction rotor 16 by passing through the magnetic field create an internal magnetic field that opposes the stator field and the induction rotor 16 rotates because of torgue generated via magnetic drag. A gear drive system 50, 21, 51, and 52 translates the rotation to the bucket 6. The other stator is then energized to create an opposite force to return the bucket 6 to its original position. By this method the bucket 6 and associated test cartridge 53 can be rotated at centrifugal speeds greater than 1000 rpm (dependent on component specifications and efficiencies), completely under microprocessor control. Generally the induction rotor 16 is composed of aluminum because it is electrically conductive but not magnetic.

A microprocessor control system is employed to send current to the respective stators to energize them and to effect rotation of the buckets independent from each other. Such switching systems for applying and shutting off current are well-known and therefore are not further discussed herein.

In practice the main centrifuge rotates counterclockwise as viewed from the top (FIG. 3). Energizing stator 101 will induce currents into induction rotor 16 in such a manner as to make the induction rotor drag clockwise. Similarly, energizing stator 100 will induce currents into that same induction rotor in a manner to drag it counterclockwise.

Referring to FIG. 4, when the induction rotor 16 turns clockwise, it rotates the large clutch gear 21 counterclockwise, which through the clutch drives the bucket 6 clockwise. When the bucket reaches stop pin 14 (FIG. 1) the clutch slip elements 22 and 23 (FIG. 1) will start to slip against each other and the induction rotor 16 will come to a slow stop in a few seconds. Similarly, when the induction rotor 16 turns counterclockwise it drives the bucket 6 counterclockwise through the same clutch slip elements 22, 23 (FIG. 1). When the bucket hits stop pin 14 (FIG. 1) in the counterclockwise direction the clutch slip elements 22 and 23 (FIG. 1) start to slip against each other and the induction rotor 16 will come to a slow stop in a few seconds.

It will be apparent that various changes and modifications can be made in the specific details of construction of a preferred embodiment of the invention as described herein, without departing from the spirit and scope of the invention, as set forth solely in the following claims.

What is claimed is:

1. A centrifuge including a main wheel for rotating a bucket means for holding objects to be subjected to centrifugal force about a main axis of rotation while such objects are simultaneously rotated about a second axis of rotation from a first to a second position comprising:

a plurality of induction rotors attached to said main wheel for rotating said induction rotors about said main axis and for positioning said induction rotors over a pair of stators;

a pair of stators mounted on a base of said centrifuge whereby said induction rotors are rotated over said stators by said main wheel; and a plurality of bucket means for holding said objects whereby said bucket means are mechanically associated with a corresponding induction rotor by gear means whereby rotation of said induction rotor is transferred to said bucket means, rotation of said bucket means causing said objects to be rotated from the first to the second position.

2. A method for rotating a bucket means for holding objects to be subjected to centrifugal force about an axis of rotation independent from and simultaneously with the main axis of rotation of a centrifuge apparatus said method comprising:

rotating an induction rotor attached to a main wheel of said centrifuge about said main axis, whereby said induction rotor is passed over a pair of stators; and energizing one of said stators to apply an appropriate magnetic field to said induction rotor whereby said induction rotor passing over said stator is caused to rotate about a second axis of rotation; said induction rotor is mechanically associated with a corresponding bucket means by gear means whereby rotation of said induction rotor is transferred to said bucket means.

3. The method of claim 2 which includes the step of energizing the other of said stators to apply a magnetic field to said induction rotor whereby said induction rotor passing over said stator is caused to rotate about a second axis of rotation in an opposite direction; said induction rotor is mechanically associated with a corresponding bucket means by gear means whereby rotation of said induction rotor is transferred to said bucket means whereby said bucket means returns to its original position.

* * * * *